US006035497A

United States Patent [19]

Jackson

[11] Patent Number: 6,035,497

[45] Date of Patent: Mar. 14, 2000

[54] ZIPPER PULL TAB

[76] Inventor: Terry R. Jackson, #2 Lariat Loop, Bozeman, Mont. 59715

[21] Appl. No.: 09/114,932

[22] Filed: Jul. 14, 1998

[51] Int. Cl.[7] ..... A44B 19/00; A44B 13/00

[52] U.S. Cl. ..... 24/429; 24/3.4; 24/419

[58] Field of Search ..... 24/429, 419, 437, 24/3.4, 3.13, 115 F, DIG. 11; 292/307 R; 70/440; 294/3.6

[56] References Cited

U.S. PATENT DOCUMENTS

| | | | |
|---|---|---|---|
| 3,873,051 | 3/1975 | Kennedy | 24/DIG. 11 |
| 4,512,064 | 4/1985 | Nishikawa | 24/429 |
| 4,920,615 | 5/1990 | Aoki et al. | 24/429 |
| 5,008,985 | 4/1991 | Thompson | 24/429 |
| 5,027,477 | 7/1991 | Seron | 24/3.4 |
| 5,093,966 | 3/1992 | Yuki et al. | 24/429 |
| 5,244,135 | 9/1993 | Nelson | 24/3.4 |
| 5,414,903 | 5/1995 | Porteous | 24/3.4 |

*Primary Examiner*—Victor N. Sakran
*Attorney, Agent, or Firm*—Pillsbury Madison & Sutro LLP

[57] ABSTRACT

A separable zipper pull tab comprises a hook piece and a zipper pull tab body having an adhesive element or a shear pin. The hook piece has a connecting arm that is secured to a connecting arch of a slider and the zipper pull tab body includes a receiving cavity which receives a portion of the hook piece. The zipper pull tab body and the hook piece are frangibly secured by an adhesive element whereby the zipper pull tab body may be separated from the hook piece upon application of a force sufficient to overcome the adhesive element.

15 Claims, 3 Drawing Sheets

ZIPPER PULL TAB

BACKGROUND OF THE INVENTION

1. Field of the Invention

The present invention relates generally to a zipper pull tab connected to a slider and specifically to a separable zipper pull tab having two separate portions secured together such that the two portions separate when sufficient force is exerted on the pull tab thereby protecting the zipper and simplifying subsequent repair.

2. Description of the Related Art

A zipper pull tab assembly traditionally includes a slider that slides along the zipper halves, called stringers, to engage and disengage interlocking links. The slider is manipulated by a pull-tab structure. Zipper pull tabs are used on a wide variety of products, including clothing and storage units such as luggage. As luggage is handled by its owner and manipulated by various handling systems, as at airports, one or more pull tabs on the luggage may become caught in a conveyor, hooked or entangled with other luggage or simply caught by some other mechanism.

Unless the force of these possible entanglements is controlled, a pull tab, the slider to which it is attached and part of the zipper itself could be ripped off the luggage.

Frequently, either or both the slider and pull tab were made from a pot metal that is not bondible but which fractures and breaks when bent. Consequently, making the slider with lugs that enclose a pull tab to allow the pull tab to pivot, or having the pull tab itself formed with a lug that encloses part of the slider can break if undue force is applied to the slider/pull tab assembly, usually to the pull tab itself.

Much difficulty has been experienced in the zipper industry with zipper systems due to the weakness of the link between the zipper pull tab and the slider or slide fastener. The link has a tendency to break under normal or excessive force placed on the system. Accordingly, when a zipper pull tab, having a normal separate link fastener, is subjected to unusual stress or force, often the pin element of the lock or fastener links are damaged. Such damage is costly to repair or replace an element of the system.

Several typical zipper pull designs are disclosed in Aoki et al., U.S. Pat. No. 4,920,615 ("Aoki"); Marinsky et al., U.S. Pat. No. 2,270,068 ("Marinsky"); and Minami, U.S. Pat. No. 4,949,434 ("Minami").

Aoki discloses a slide fastener slider having a supporting body and a pull tab support, such that the pull tab can be attached quickly and yet be removable. The pull tab support is shaped so as to define a gap for loosely receiving an annular portion of the pull tab and has an inner surface engaging structure. The pull tab has a substantially U-shaped resilient member having at the opposite ends fitting joints for fitting engagement with the engaging means, to thus close the gap. While Aoki discloses a zipper pull in which a resilient member can be removably attached to a support body, it does not address or solve the problem of how to prevent damage to the zipper pull if excessive forces pull or yank on the pull tab itself. Therefore, if the pull tab is yanked off the slide, costly replacement or repair must be undertaken.

Marinsky discloses a lock slider for a zipper where the slider may be maintained against movement longitudinally along the zipper under normal tensions which tend to separate the links 15 hold on stringers 14. This reference discloses a positive engagement provided by the zippers between the slider and the links of the fastener that does not yield to abnormal stresses placed upon the fastener stringers. With unusual transverse stress, the fasteners can separate, and the pin 17 will break, the baring apertures 19, 19*a* can break or the entire slider could disengage from links 15, 15*a*.

Minami discloses a slide fastener slider which has a "c" pull tab which is thinned across a portion of the tab making that area easily bendable when subjected to severe pressure or force and hence preventing injury the user's body when the user accidentally strikes the pull tab. The concept is illustrated in FIG. 2 of the reference. Minami's zipper pull still does not adequately address the problems associated with the entire pull tab being broken from the slider or the slider itself being broken away from the zipper links.

Accordingly, in the conventional zipper pull design, when the zipper pull is forced from the slider, the zipper or slider or perhaps both must be removed and replaced or repaired, which is costlier than simply replacing the zipper pull tab.

SUMMARY OF THE INVENTION

What is needed is an inexpensive and effective zipper pull design which includes and effectively locates a weak link in the zipper pull tab rather than the slider or the connection between the zipper tab and the slider crown.

It is an object of the present invention to provide a zipper pull design in which a hook piece allows a multipiece zipper pull to have one part be easily yet positively fastened to a slider and the remainder pull tab body is configured so as to engage and fit with the hook piece with the two being frangibly secured together. This arrangement allows the frangible connection to give way and yield when the zipper pull tab is pulled or yanked with excessive force thereby saving the slider and zipper from damage.

It is another object of the invention to provide an economical method of returning a broken zipper pull to normal use rather than replacing the entire zipper pull system or replacing or repairing the slider or the zipper links.

It is another object of the present invention to provide an economical and convenient design for manufacturing a zipper pull which accomplishes the goals described herein.

A hook piece, having a received portion and a connecting arm, is fastened to a connecting arch formed in the crown of a slider. The connecting arm and the received portion is then inserted into a receiving cavity of a zipper pull tab body. The body of the zipper pull tab can, for example, slide over the hook piece and then can be frangibly secured to the hook piece by, a pin, a retaining clip or an adhesive. This configuration allows the crown of the slider piece to be solid which strengthens the slider. The zipper pull tab encompasses the zipper pull body connected to the hook piece.

When excessive force is applied to the zipper pull tab, the body of the zipper pull and the hook piece separate. The strength of the pin or adhesive may be adjusted according to a desired level of breaking force. One exemplary way to control the level of breaking force is to notch the pin. By insuring that the weak link in the whole system is located in the zipper pull tab with the frangible connection between the zipper pull body and the hook piece, the slider may remain intact when excessive force is exerted on the zipper pull tab. Furthermore, easy replacement of a new zipper pull body on the hook piece may be accomplished as would be the replacement of both the hook piece and a new zipper pull body. Alternatively, the hook portion of the hook piece may be arranged to yield and pull away from the zipper pull tab body rather than having a frangible connection between the hook piece and the zipper pull tab body.

Many other advantages and features of the present invention will become manifest to those versed in the art upon making reference to the following detailed description and the accompanying sheets of drawings in which a preferred structural embodiment incorporating the principles of the present invention is shown by way of illustrative example.

DETAILED DESCRIPTION OF THE INVENTION

Figure 1:
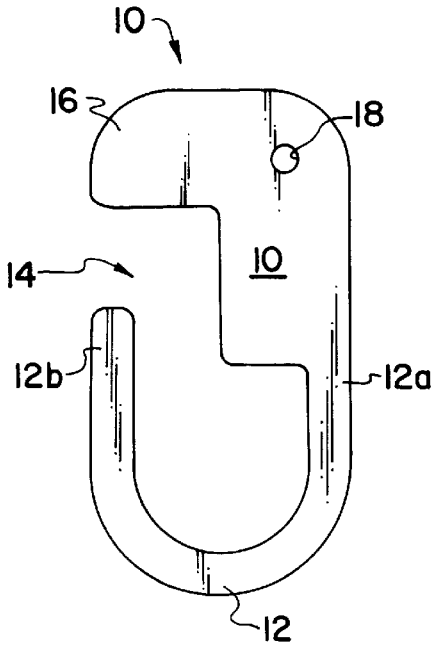
FIG. 1 is a plan view of the hook piece.
Figure 10:
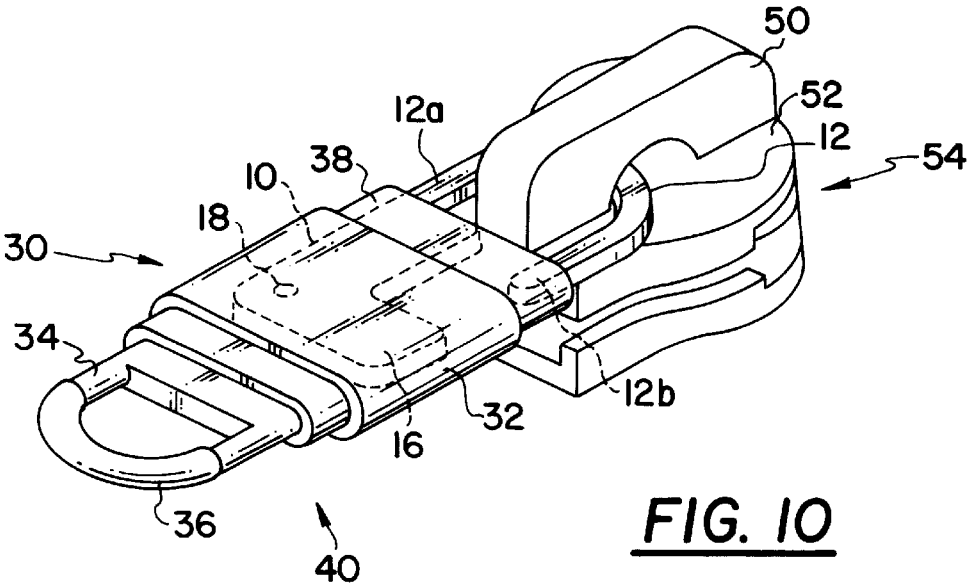
FIG. 10 is a plan view illustrating the zipper pull tab of the present invention loosely connected to a connecting arch of a slider.

Referring first to FIG. 1, a hook piece 10 has a U-shaped connecting arm 12 a first end 12*a* of which is connected to and extends from a received portion 16. A second end 12*b* of connecting arm 12 extends a toward the opposite side of and is spaced from the received portion 16 with such space providing a slider reception region 14 which allows for securing the connecting arm 12 through a connecting arch 50 formed in the crown 52 of a slider 54, as shown in FIG. 10. The received portion 16 can include a hole or aperture 18 that can be used to removably engage the hook piece 10 to the zipper pull tab body 30 in FIG. 3. The hook piece 10, and the pull tab body 30 are preferably made from stainless steel but may be other materials as well, such as, for example, plastics, other man-made material, aluminum and other metals or combinations of such materials, without departing from the concept or scope of the invention. When connected and in operating mode, the zipper pull assembly 42 connected to a slider 54 operates as a conventional zipper.

Figure 2:
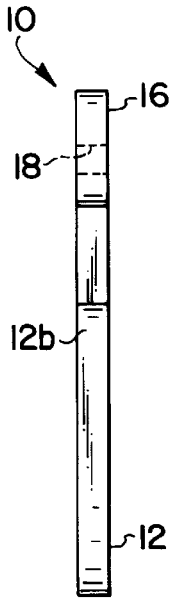
FIG. 2 is a side edge view of the hook piece.

FIG. 2 illustrates a side edge view of the hook piece 10 and illustrates its general profile as being relatively flat. This enables the hook piece 10 and specifically the received portion 16 to be, preferably, slidably received into the receiving cavity 40 of the zipper pull tab body 30 shown in FIGS. 5–7.

Figure 3:
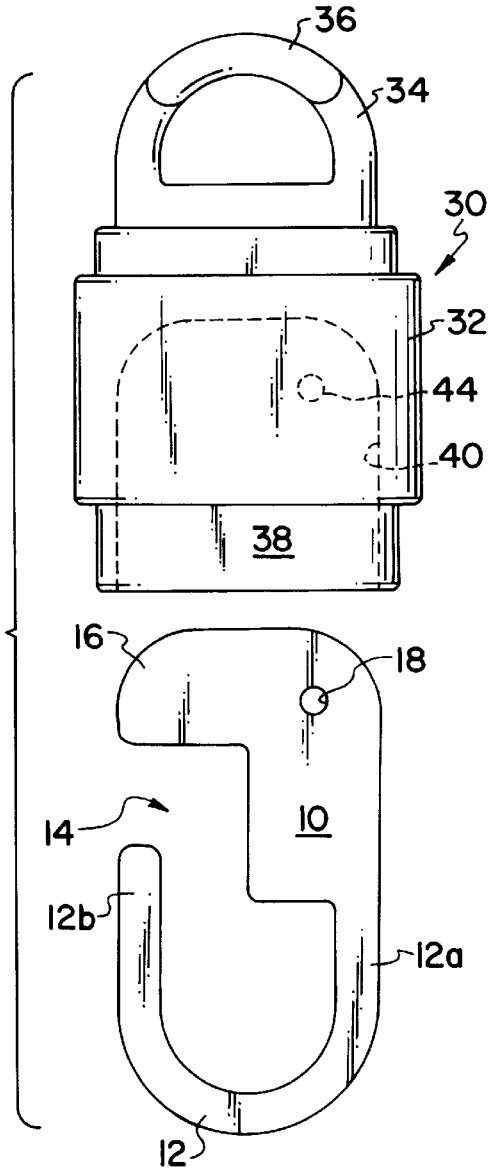
FIG. 3 is an exploded plan view of the hook piece and the zipper pull body separated from each other.
Figure 4:
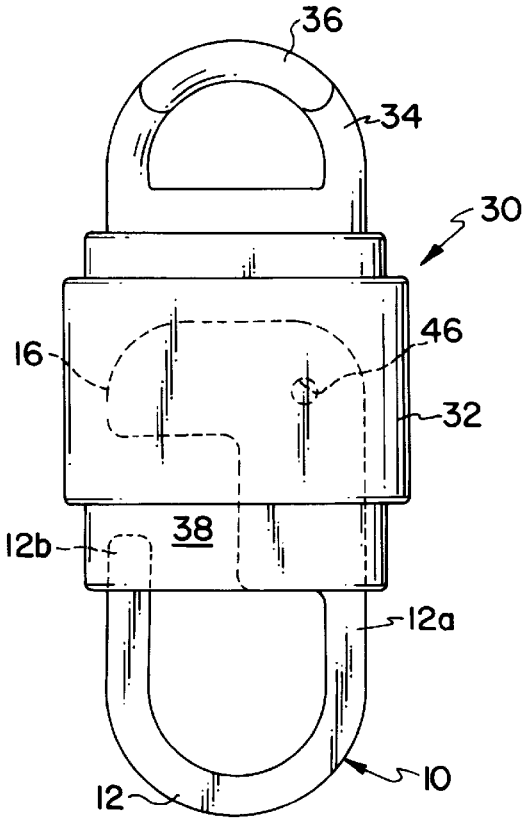
FIG. 4 is a plan view illustrating the connected relationship between the hook piece and the zipper pull body.
Figure 9:
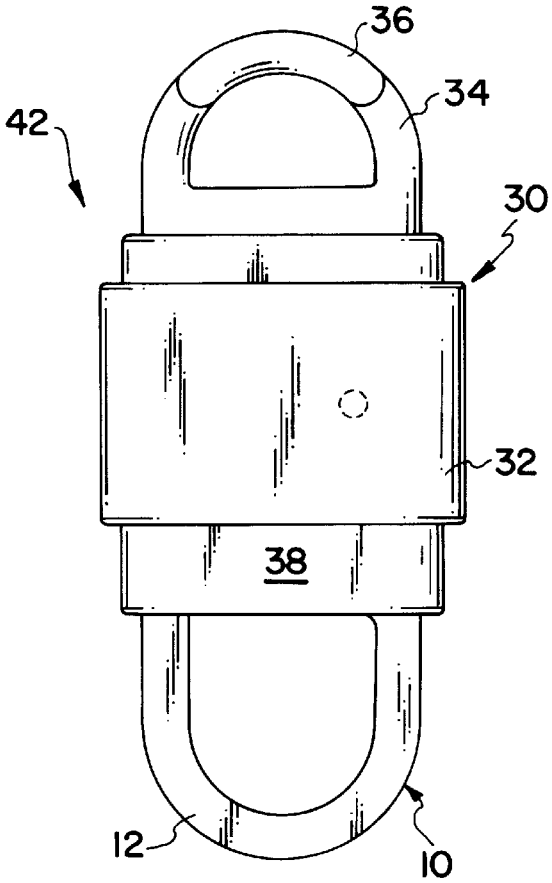
FIG. 9 is a plan view of a completed zipper pull assembly therein. The zipper pull assembly of the present invention, shown at 42 in FIG. 9, includes at least two pieces, a hook piece 10, shown in FIG. 1, and a pull tab body 30, shown in FIG. 3.

FIG. 3 illustrates the pre-connected positions of the hook piece 10 and the pull tab body 30. The received portion 16 is located at the entrance of the receiving cavity 40 of the zipper pull tab body 30. The pull tab body 30 has a lower section 32 which is sufficiently wide to enclose and define the hollow receiving cavity 40, a middle, narrower section 34 and a top, wider section 36 for ease of pulling. The zipper pull tab body 30 also includes an outer rim portion 38 depending outwardly from section 32. As shown in FIG. 4, rim portion 38 overlies second end 12*b* of connecting arm 12. Consequently, when the zipper pull assembly 42, as in FIG. 9, is completed, the opening 14 is closed and the connecting arm 12 cannot be disconnected from the slider. In the closed position, the zipper pull body 30 and the hook piece 10 comprise a completed zipper pull assembly 42. The zipper pull tab body 30 may be made from the materials referred above, including plastic material, as well as zinc or other cast metal or alloy.

FIG. 4 illustrates the interaction between the hook piece 10 and the pull body 30 when they are connected.

Figure 5:
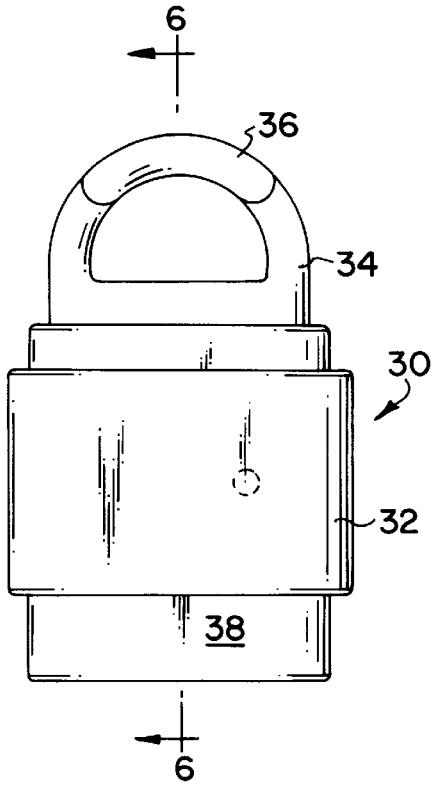
FIG. 5 is a plan view of the zipper pull body.
Figure 6:
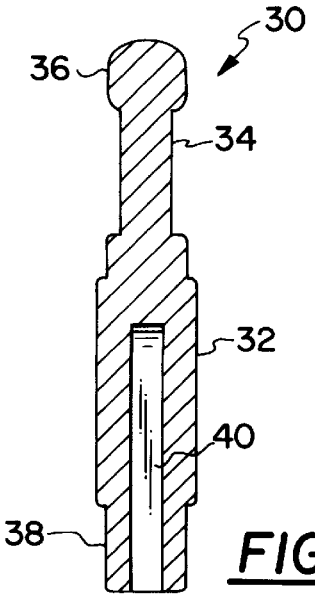
FIG. 6 is a cross sectional view of the zipper pull body taken along the line 6—6 in FIG. 5.
Figure 8:
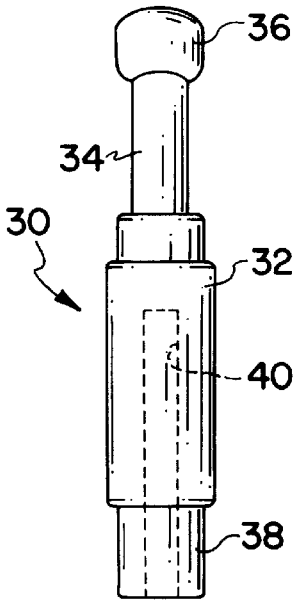
FIG. 8 is a side edge view of the zipper pull body.

FIG. 6, shows a cross-sectional view of the pull body 30 shown in FIG. 5 and specifically shows the location of the hollow receiving cavity 40 for the hook piece 10. The varying thickness of the lower section of the body 32, the middle and top sections 34 and 36, and the rim 38 are also demonstrated with FIG. 8 showing the outer edge profile of the pull tab body.

Figure 7:
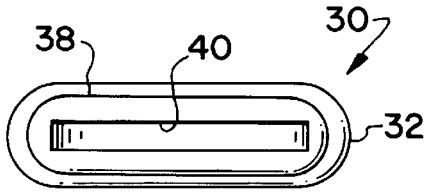
FIG. 7 is an end view of the zipper pull body looking into the receiving cavity.

FIG. 7 shows the open end of the zipper pull body 30 looking into receiving cavity 40. The frangible connection between the pull tab body 30 and the hook piece 10 can be accomplished in a variety of approaches. One would be to include an opening, as at 44 in FIG. 3, at least in one side of the pull tab body 30 aligned with the position of hole or aperture 18 and to subsequently insert a breakaway pin 46 there through. Depending upon the material selected for pin 46, including, for example, plastic, steel, aluminum or brass, the amount of force required to cause the pull tab to be separated from the hook piece 10 can be both varied and controlled. Pin 46 can have the following exemplary effective diameter sizes: steel at about 0.003", aluminum at about 0.005", brass at about 0.004", and plastic can very from about 0.010" to 0.030".

The pin 46 could be a solid uniformly dimensioned pin or it could be notched to coincide with the interface between the outer surface of the received portion 16 and the interior surface of receiving cavity 40.

The above pin dimensions are exemplary of the dimensions needed to permit frangibility of a lower end of the force ranges. Accordingly, as one wishes to increase the force required to break the frangible connection, these sizes need to be increased.

An alternative to use of a pin 46 would be to use an adhesive, such as for example, duro super glue or LocTite A30, between the outer surface of the received portion 16 and the interior of cavity 40.

Other alternatives include using a relative clip positioned internally within cavity 40; press-fitting the hook piece 10 into the cavity 40; using a snap-in-dimple that would snap into a hole or other recess within either the hook piece 10 or receiving cavity 40; or a spring loaded snap-fit mechanism.

FIG. 10 shows the hook piece 16 of the zipper pull tab 30 loosely connected to the connecting arch 50 which extends from the crown 52 of a slider 54.

A method according to the present invention is applied in a zipper pull system comprising a slider 54, a zipper pull assembly 42 including a hook piece 10 and a pull tab body 30. The method comprises providing separation of the hook piece 10 from the pull tab body 30 by engaging the hook piece 10 to the slider 54 through a connecting arch 50 on the slider crown 52; inserting a received portion 16 of the hook piece 10 into a receiving cavity 40 in the pull tab body 30; securing the hook piece 10 to the pull tab body 30 through a frangible connection 46 to form a zipper pull assembly 42. Upon sufficient force being exerted on the pull tab assembly 42, the pull tab body 30 may be released from the hook piece 10 to separate the hook piece 10 from the pull tab body 30 to thereby prevent damage to the hook piece 10 or slider 54.

As an alternative structure in the method of the present invention, the hook piece 10 may comprise a received portion 16 and a connecting arm 12. The method then further comprises engaging the connecting arm 12 of the hook piece 10 to a slider 54 through a connecting arch 50 on the slider 54; inserting a received portion 16 of the hook piece 10 into a receiving cavity 40 in the zipper pull tab body 30; securing the hook piece 10 to the pull tab body 30 through an adhesion element 46 to form a zipper pull tab 42; and upon sufficient force being exerted on the zipper pull tab assembly 42, separating the zipper pull body 30 from the hook piece 10 to thereby prevent damage to the zipper pull tab 42 or slider 54.

As an alternative to using a frangible connection between the zipper pull tab body 30 and the received portion 16, it is also within this invention to use a super-glue type of adhesive between the received portion 16 and the receiving cavity 40. In such a case, the connecting arm 12 is constructed from stainless steel with a size that permits the connecting arm 12 to yield to the point that end 12*b* will disengage from receiving cavity 40 thereby releasing slider 54.

This technique prevents damage to the zipper itself and places the weak link in the zipper pull assembly, and directly in the pull tab rather than in the slide crown or the zipper. Although the description above contains many specificities, these should not be construed as limiting the scope of the invention but as merely providing illustrations of some of the presently preferred embodiments. For example, the varying thickness, widths or shape of the pull body may be altered or changed without departing from the principles of the present invention. As another example, those skilled in the art may use various kinds of adhesives to practice this invention, or may locate an adhesive at or by various positions on the received portion 16 of the hook piece 10.

Thus the scope of the invention should be determined by the appended claims and their legal equivalents, rather than by the examples given.

What is claimed is:

1. A separable zipper pull comprising:

a hook piece; and a pull tab body, the pull tab body being frangibly connected to the hook piece and the pull tab body being separable from the hook piece upon application of a force stronger than the frangible connection therebetween.

2. The separable zipper pull of claim 1, wherein the frangible connection element is a shear pin.

3. The separable zipper pull of claim 2, wherein the shear pin is notched to control the amount of force required to break the frangible connection.

4. The separable zipper pull of claim 1, wherein the frangible connection element is a retaining clip.

5. The separable zipper pull of claim 1, wherein the frangible connection is an adhesive.

6. The separable zipper pull of claim 1, wherein the frangible connection is a connecting arm of the hook piece which yields to said force.

7. The separable zipper pull of claim 1, wherein the hook piece comprises:

a connecting arm; and an insert portion;

said pull tab body including a cavity adapted to receive said insert portion.

8. The separable zipper pull of claim 7, wherein the insert portion further comprises:

an adhesive region where adhesive engages the adhesive region to form an adhesive bond which secures the hook piece to the pull tab body, whereby upon exertion of a force sufficient to overcome the adhesive connection between the zipper pull tab body and the hook piece, the adhesive bond will break, thus preventing damage to other elements of the zipper.

9. The zipper pull of claim 7, wherein the frangible connection is a connecting arm of the hook piece which yields to said force.

10. In a zipper pull system comprising a zipper pull tab and a hook piece a method of providing a frangible zipper pull comprising:

frangibly connecting the zipper pull tab to the hook piece; and separating the hook piece from the zipper pull upon application of a force sufficient to overcome the frangible connection.

11. In a zipper pull system comprising a slider, a zipper pull including a hook piece and a pull tab, a method of providing separation of the hook piece from the pull tab comprising:

engaging the hook piece to the slider through a connecting arch on the slider;

inserting a received portion of the hook piece into a receiving cavity in the pull tab;

securing the hook piece to the pull tab through a frangible connection to form a zipper pull; and upon sufficient force being exerted on the pull tab, releasing the pull tab from the hook piece to separate the hook piece from the pull tab to thereby prevent damage to the hook piece or slider.

12. The method of claim 11, wherein the hook piece comprises a received portion and a connecting arm, further comprising:

engaging the connecting arm of the hook piece to a slider through a connecting arch on the slider;

inserting a received portion of the hook piece into a receiving cavity in the zipper pull tab body;

securing the hook piece to the pull tab body through an adhesion element to form a zipper pull tab; and upon sufficient force being exerted on the zipper pull tab, separating the zipper pull body from the hook piece to thereby prevent damage to the zipper pull tab or slider.

13. The method of claim 12, wherein the frangible connection is the connecting arm which yields to said force.

14. The method of claim 11, wherein the frangible connection is a shear pin.

15. The method of claim 14, wherein the shear pin is notched to control the force required to break the frangible connection.

* * * * *